US011638491B2

(12) United States Patent
Cato

(10) Patent No.: US 11,638,491 B2
(45) Date of Patent: May 2, 2023

(54) DISPLAY CASE FOR WINDOW COVERINGS

(71) Applicant: Cato Janitorial Services, Inc., Fuquay-Varina, NC (US)

(72) Inventor: Robert M. Cato, Fuquay-Varina, NC (US)

(73) Assignee: Cato Janitorial Services, Inc., Fuquay-Varina, NC (US)

( * ) Notice: Subject to any disclaimer, the term of this patent is extended or adjusted under 35 U.S.C. 154(b) by 276 days.

(21) Appl. No.: 17/089,203

(22) Filed: Nov. 4, 2020

(65) Prior Publication Data

US 2021/0153669 A1 May 27, 2021

Related U.S. Application Data

(60) Provisional application No. 62/940,608, filed on Nov. 26, 2019.

(51) Int. Cl.

| | |
|---|---|
| ***A47F 5/00*** | (2006.01) |
| ***A47F 7/00*** | (2006.01) |
| ***G09F 5/00*** | (2006.01) |
| ***E06B 9/24*** | (2006.01) |
| ***E06B 9/264*** | (2006.01) |
| ***E06B 9/266*** | (2006.01) |

(52) U.S. Cl.
CPC ..... *A47F 7/0021* (2013.01); *A47F 5/00* (2013.01); *E06B 9/24* (2013.01); *E06B 9/264* (2013.01); *E06B 9/266* (2013.01); *G09F 5/00* (2013.01)

(58) Field of Classification Search
CPC . E06B 9/24; E06B 9/264; E06B 9/266; E06B 9/42; E06B 9/17; E06B 9/1703; E06B 9/323; E06B 2009/527; E06B 2009/015; A47H 1/14; A47H 1/142; A47H 1/144
See application file for complete search history.

(56) References Cited

U.S. PATENT DOCUMENTS 790,440 A * 5/1905 Klein ..... A47F 7/163 211/45
1,086,181 A * 2/1914 Isaacs ..... A47F 5/0018 211/1
1,280,174 A * 10/1918 Dancer ..... A47F 7/163 211/196

(Continued)

FOREIGN PATENT DOCUMENTS

GB 2431861 A * 5/2007 ..... A47H 1/13
KR 10-1259614 5/2013
WO WO-2020035613 A1 * 2/2020 ..... E06B 9/264

*Primary Examiner* — Johnnie A. Shablack
(74) *Attorney, Agent, or Firm* — Kevin E Flynn; Flynn IP Law

(57) ABSTRACT

An assembly for display of a window covering having a display case and a window covering attached to a display board. The a display case adapted to reversibly hold a display board near the top of the display case through a magnetic bond between the display case and the display board. Mounting hardware for the window covering is engaged with the display board. The window covering is engaged with mounting hardware so that the window covering with the mounting hardware, and the display board may be removed from the display case such that a different mounting board with a different set of mounting hardware and a different window covering may be inserted in the display case to demonstrate the appearance and functionality of the window covering.

13 Claims, 12 Drawing Sheets

(56) References Cited

U.S. PATENT DOCUMENTS 5,226,466 A * 7/1993 Goddens ..... E06B 9/264 160/176.1 R
5,230,493 A * 7/1993 Luoto ..... E06B 9/323 248/254
7,093,643 B2 * 8/2006 Ikle ..... E06B 9/40 160/271
7,210,587 B1 * 5/2007 Singer ..... A47F 7/146 211/55
7,284,736 B2 * 10/2007 Franssen ..... E06B 9/323 248/220.21
8,074,698 B2 * 12/2011 Allsopp ..... E06B 9/266 160/369
8,479,799 B2 * 7/2013 Hugin ..... E06B 9/362 160/177 V
8,496,039 B1 * 7/2013 Barresi ..... E06B 7/09 49/87.1
8,640,761 B2 * 2/2014 Potter ..... A01K 1/035 160/213
8,991,468 B2 * 3/2015 Bolton, III ..... E06B 9/262 160/168.1 R
9,903,155 B1 * 2/2018 Wagner ..... E06B 9/30
10,487,502 B2 * 11/2019 Geiger ..... A47H 1/13
10,604,998 B2 * 3/2020 Greene ..... G09F 5/02
11,306,533 B2 * 4/2022 Teuscher ..... E06B 9/262
2005/0153517 A1 * 7/2005 Kim ..... E06B 9/264 438/396
2005/0274868 A1 * 12/2005 McCance ..... A47H 1/142 160/902
2006/0000560 A1 * 1/2006 Lewis ..... E06B 9/266 160/38
2007/0284065 A1 * 12/2007 Gitkin ..... E06B 9/266 160/262
2010/0307696 A1 * 12/2010 Bolton, III ..... E06B 9/323 160/368.1
2013/0032552 A1 * 2/2013 Faltin ..... D21H 27/20 211/13.1
2015/0096695 A1 * 4/2015 Baker ..... E06B 9/44 160/239
2016/0186490 A1 * 6/2016 Teuscher ..... E06B 9/36 160/181
2019/0249433 A1 * 8/2019 Guest ..... E06B 9/58
2020/0018113 A1 * 1/2020 Goldman ..... B29C 66/437
2021/0153669 A1 * 5/2021 Cato ..... A47H 1/00
2022/0235605 A1 * 7/2022 Teuscher ..... E06B 9/368

* cited by examiner

DISPLAY CASE FOR WINDOW COVERINGS

This application claims the benefit of co-pending and commonly assigned U.S. Provisional Patent Application No. 62,940,608 filed Nov. 26, 2019 for Window Covering Display System and Method of Use. The '608 application is incorporated by reference in its entirety.

BACKGROUND

Field of the Disclosure

This disclosure relates generally to display cases for window coverings such as blinds, shades, shutters, or curtains. This list is meant to be explanatory rather than limiting. There may be other types of window coverings that may benefit from the present disclosure.

Related Art

It is known in the art that an effective way to sell window coverings is to bring samples of the window coverings to a customer's home or place of business so that the customer can assess how the window covering will look in the location where it will be used rather than view the product in a store showroom.

Recently issued U.S. Pat. No. 10,604,998 for Shading Display and Sample taught the use of a window covering that was permanently mounted in a frame structure with integral drive structures to allow a set of shades to be opened and closed to demonstrate a particular window covering through the use of this portable display frame. The '998 patent teachings require that each window covering be permanently mounted in a frame structure that may include other features unrelated to the window covering such as handles for carrying the display case. Thus a dealer with a hundred possible window coverings (which may include several different color choices for a particular type and brand of window covering) would need to pay for a hundred frames.

Vocabulary.

Or.

Unless explicit to the contrary, the word "or" should be interpreted as an inclusive or rather than an exclusive or. Thus, the default meaning of or should be the same as the more awkward and/or.

Set.

Unless explicit to the contrary, the word "set" should be interpreted as a group of one or more items.

Gne and Gnes.

To avoid the awkward he/she and his/her or the potentially confusing singular use of they and their, this application uses the gender-neutral pronoun gne and the possessive gnes.

Step.

The term step may be used in descriptions within this disclosure. For purposes of clarity, one distinct act or step may be discussed before beginning the discussion of another distinct act or step. The term step should not be interpreted as implying any particular order among or between various steps disclosed unless the specific order of individual steps is expressly indicated.

Substantially.

Frequently, when describing an industrial process it is useful to note that a given parameter is substantially met. Examples may be substantially parallel, substantially perpendicular, substantially uniform, and substantially flat. In this context, substantially X means that for purposes of this industrial process it is X. So something that may not be absolutely parallel but is for all practical purposes parallel, is substantially parallel. Likewise, mixed air that has substantially uniform temperature would have temperature deviations that were inconsequential for that industrial process.

As recognized in C. E. Equipment Co. v. United States, 13 U.S.P.Q.2d 1363, 1368 (Cl. Ct. 1989), the word "substantially" in patent claims gives rise to some definitional leeway—thus the word "substantially" may prevent avoidance of infringement by minor changes that do not affect the results sought to be accomplished.

SUMMARY OF THE DISCLOSURE

Aspects of the teachings contained within this disclosure are addressed in the claims submitted with this application upon filing. Rather than adding redundant restatements of the contents of the claims, these claims should be considered incorporated by reference into this summary.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provided below as one of skill in the art will recognize that inventive concepts illustrated in various examples can be combined together in order to address a specific application.

Some aspects of the teachings of the present disclosure may be expressed as an assembly for display of a window covering, the assembly including:

a display case with a top, left side, right side, and bottom, thus having two side walls; the display case adapted to reversibly hold a display board near the top of the display case through a magnetic bond between the display case and the display board;

a set of at least one piece of mounting hardware for the window covering, the set of at least one piece of mounting hardware engaged with the display board; and the window covering engaged with the set of at least one piece of mounting hardware so that the window covering, the set of at least one pieces of mounting hardware, and the display board may be removed from the assembly such that a different mounting board with a different set of at least one piece of mounting hardware and a different window covering may be inserted in the display case.

Other aspects of the teachings of the present disclosure may be expressed as a process for using a single display case to sequentially display two different window coverings, the process including:

mounting a first set of hardware to a first display board to allow a first window covering to be attached to the first display board;

attaching the first window covering to the first set of hardware attached to the first display board;

mounting a second set of hardware to a second display board to allow a second window covering to be attached to the second display board;

attaching the second window covering to the second set of hardware attached to the second display board;

inserting the first display board with the attached first window covering into the single display case so that a first magnetic bond between the first display board and the single display case secures the first display board into the single display case;

manipulating the first window covering to alter an ability of the first window covering to block light from passing from a distal side of the single display case to a viewer on a proximal side of the single display case;

removing the first display board with the attached first window covering from the single display case after overcoming the magnetic bond between the first display board and the single display case that previously secured the first display board into the single display case;

inserting the second display board with the attached second window covering into the single display case so that a second magnetic bond between the second display board and the single display case secures the second display board into the single display case; and manipulating the second window covering to alter an ability of the second window covering to block light from passing from the distal side of the single display case to the viewer on the proximal side of the single display case.

Other systems, methods, features and advantages of the disclosed teachings will be immediately apparent or will become apparent to one with skill in the art upon examination of the following figures and detailed description. It is intended that all such additional systems, methods, features and advantages be included within the scope of and be protected by the accompanying claims.

BRIEF DESCRIPTION OF THE FIGURES

The disclosure can be better understood with reference to the following figures. The components in the figures are not necessarily to scale, emphasis instead being placed upon illustrating the principles of the disclosure. Moreover, in the figures, like reference numerals designate corresponding parts throughout the different views.

DETAILED DESCRIPTION

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Figure 1:
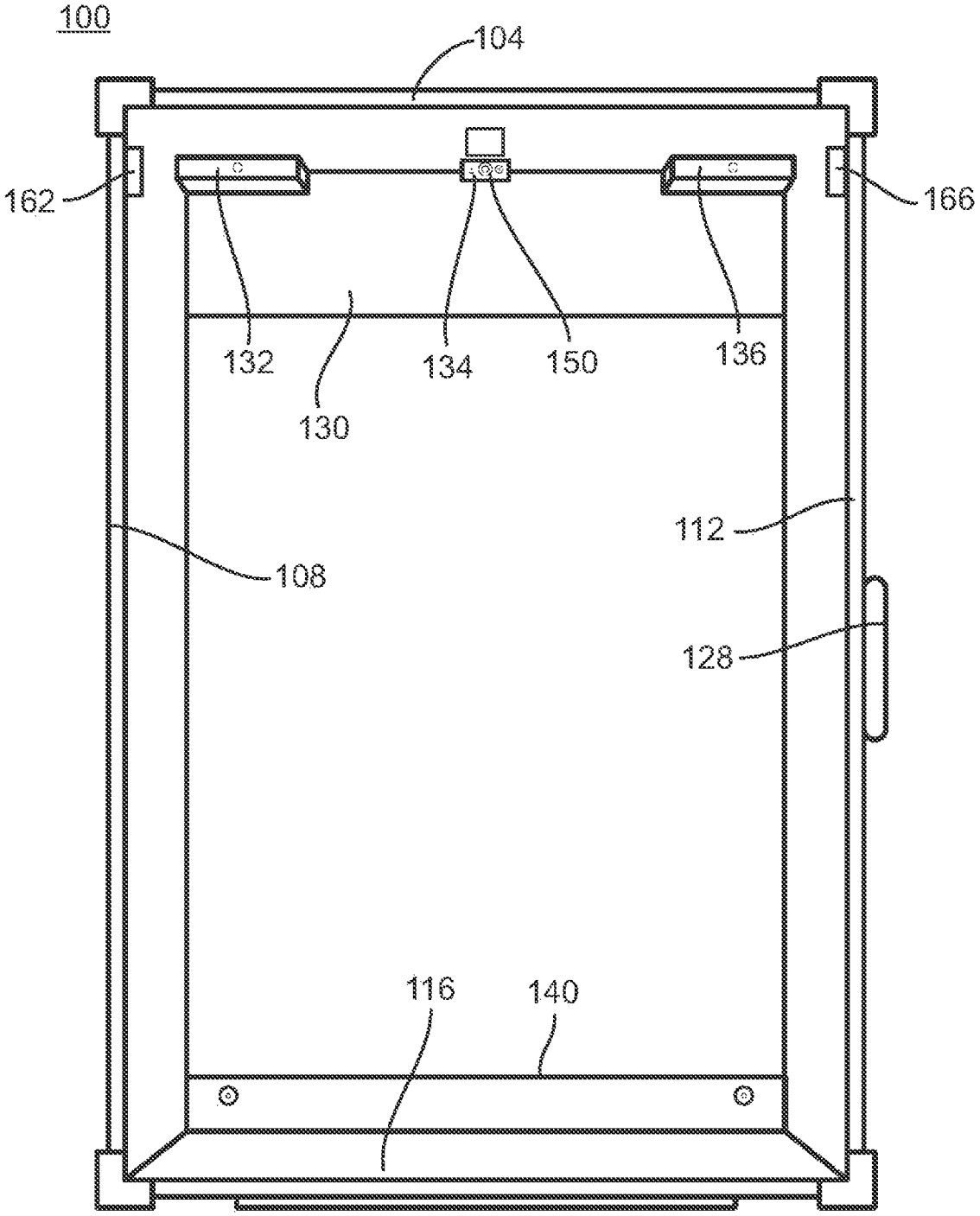
FIG. 1 shows a front view of display case 100.

FIG. 1 shows a front view of display case 100. The display case 100 may be rectangular as shown here or it may be square or some other shape that emulates a window opening. The display case has a top 104, left side 108, right side 112, and bottom 116. The four sides may be joined together to form a perimeter using any conventional means. The outer perimeter may have one or more handles 124, 128 to make the display case 100 easier to pick up and position for display.

The display case 100 has a bottom backstop. The bottom backstop 140 is on the distal side of the display case 100. The bottom backstop 140 may have a distal side that is flush with the distal faces of the bottom 116, left side 108 and right side 112 for aesthetic purposes although not required for functional purposes. One of skill in the art will appreciate that the bottom backstop 140 will augment the stability of the display case 100. One of skill in the art will appreciate that the bottom backstop 140 provides a place where an additional magnetic bond can connect a window covering actuator to the bottom backstop 140 as some window coverings have an actuator that is normally mounted on the lower portion of the window.

Finally, there are blinds or shades that are sold for mounting on a door. As the door moves as it is opened or closed, it is common for those items targeted for use on doors to have a lower anchor plate to keep the item from swinging away from the door as the door is moved. The lower backstop 140 can be used with magnetic coupling to temporarily affix the lower anchor plate of the item to the lower backstop 140.

The display case 100 has a top backstop 130. The top backstop 130 is on the distal side of the display case 100, flush with the distal ends of the top 104, left side 108, and right side 112 for aesthetic purposes although not required for functional purposes. The top backstop 130 may be connected to the perimeter formed by top 104, left side 108, right side 112, and bottom 116 in any conventional manner. One conventional manner is to provide inclined screw channels 138 (FIG. 3) so that a screw can connect a portion of the top backstop 130 to the adjacent side.

The top backstop 130 may have a series of spacers 132, 134, and 136 although the number of spacers could be different from three. In a preferred embodiment, spacer 134 includes a magnet 150 so that a plane including a proximal face 144 of the bottom backstop 140 includes the proximal planes of spacers 132 and 136 and magnet 150.

As described in more detail below, a pair of display board supports 162 and 166 define a lower plane to limit the position of a display board 200 (discussed below).

Figure 2:
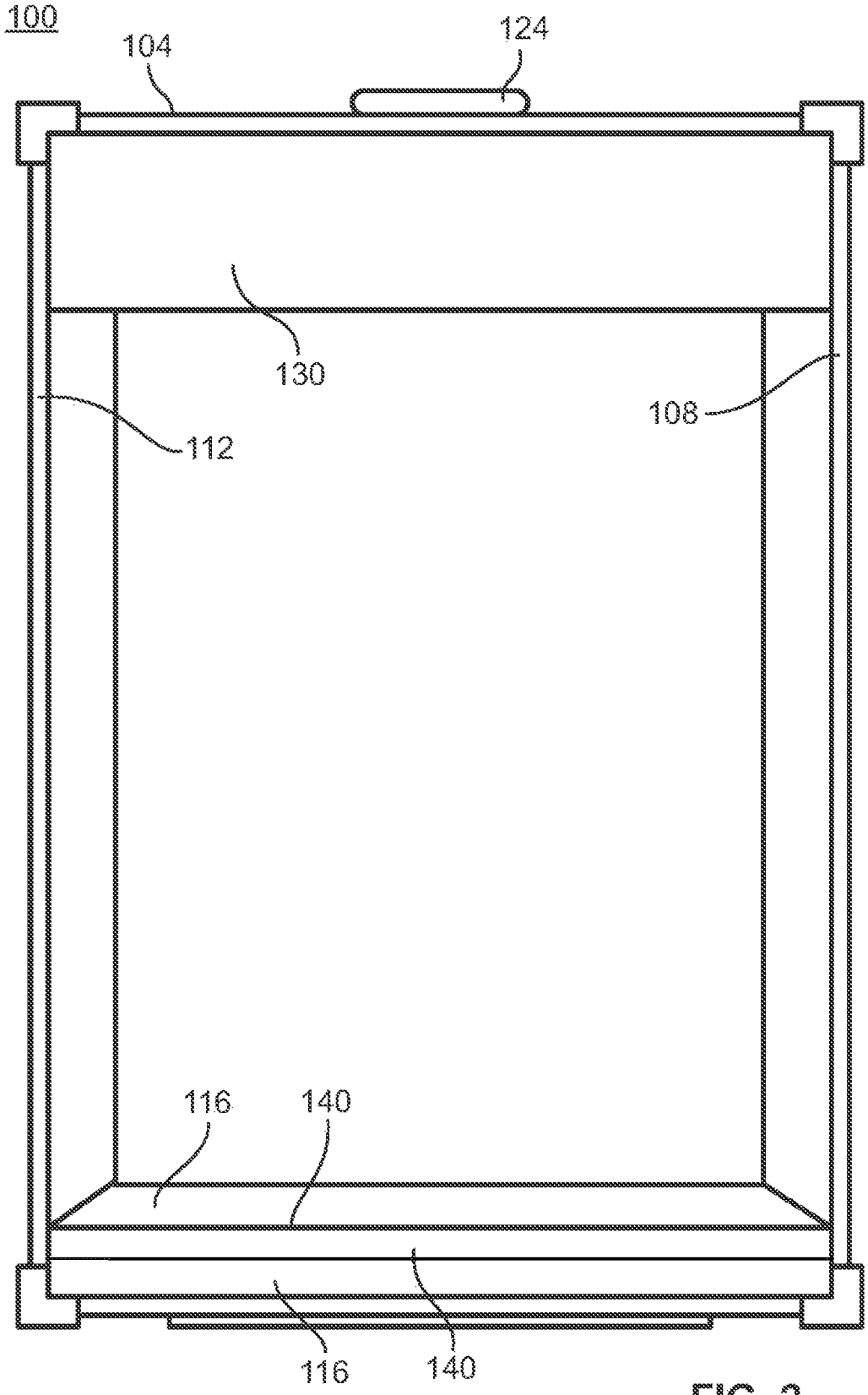
FIG. 2 shows a rear side of a display case 100.

FIG. 2 shows a rear side of a display case 100. This display case 100 has a top handle 124 on the top 104.

Figure 3:
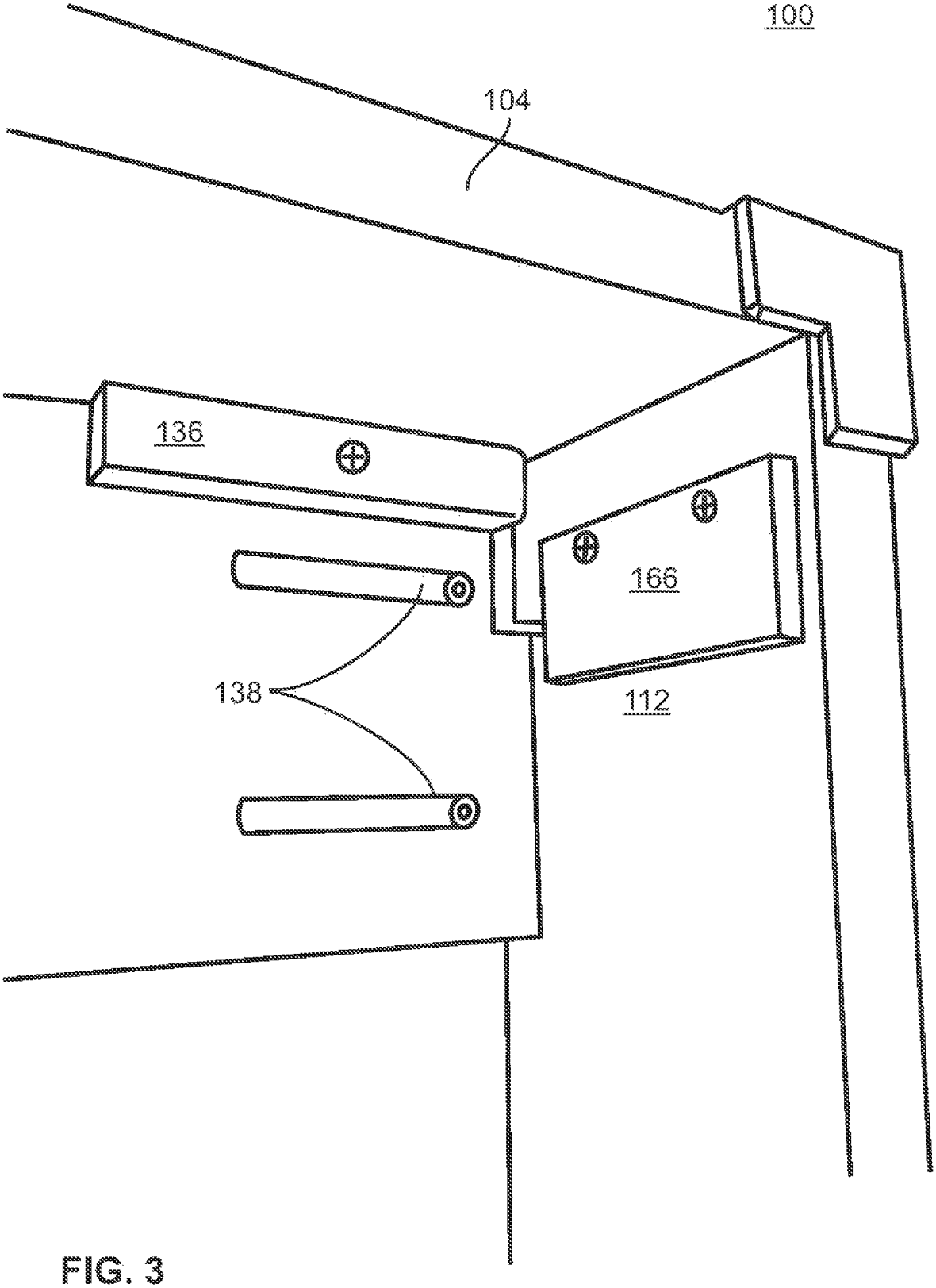
FIG. 3 shows an enlarged portion of the front of the display case 100 showing the details of the upper right corner.

FIG. 3 shows an enlarged portion of the front of the display case 100 showing the details of the upper right corner. Visible in this view are the screw channels 138 which is one technique known in the art for joining pieces of wood.

FIG. 3 shows that a display board 200 with a length that extends from the inner face of the left side 108 to the inner face of the right side 112 would be constrained by the top 104, right side 112, spacer 136 and display board support 166. The left end of the display board 200 would be similarly constrained by top 104, left side 108, spacer 132, and display board support 162.

Figure 4:
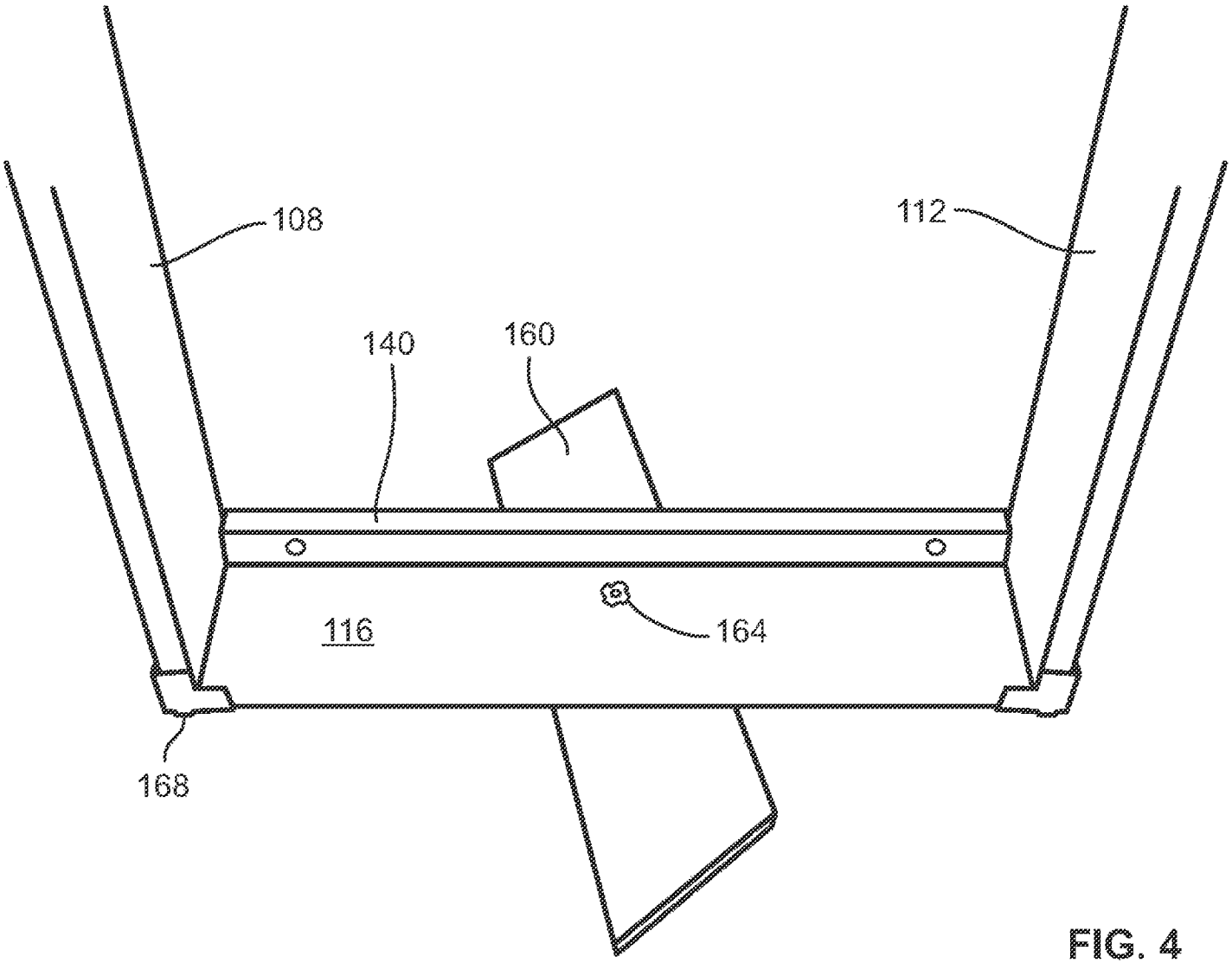
FIG. 4 is a look at the front of the display case 100 but with a focus on the lower portion.

FIG. 4 is a look at the front of the display case 100 but with a focus on the lower portion. Previously introduced elements: left side 108, bottom 116, right side 112, and bottom backstop 140 are visible. The bottom 116 may have a set of feet 168 near the left side 108 and the right side 112. For additional stability, an optional outrigger 160 may be rotatably connected to the bottom 116 by swivel point 164.

Figure 5:
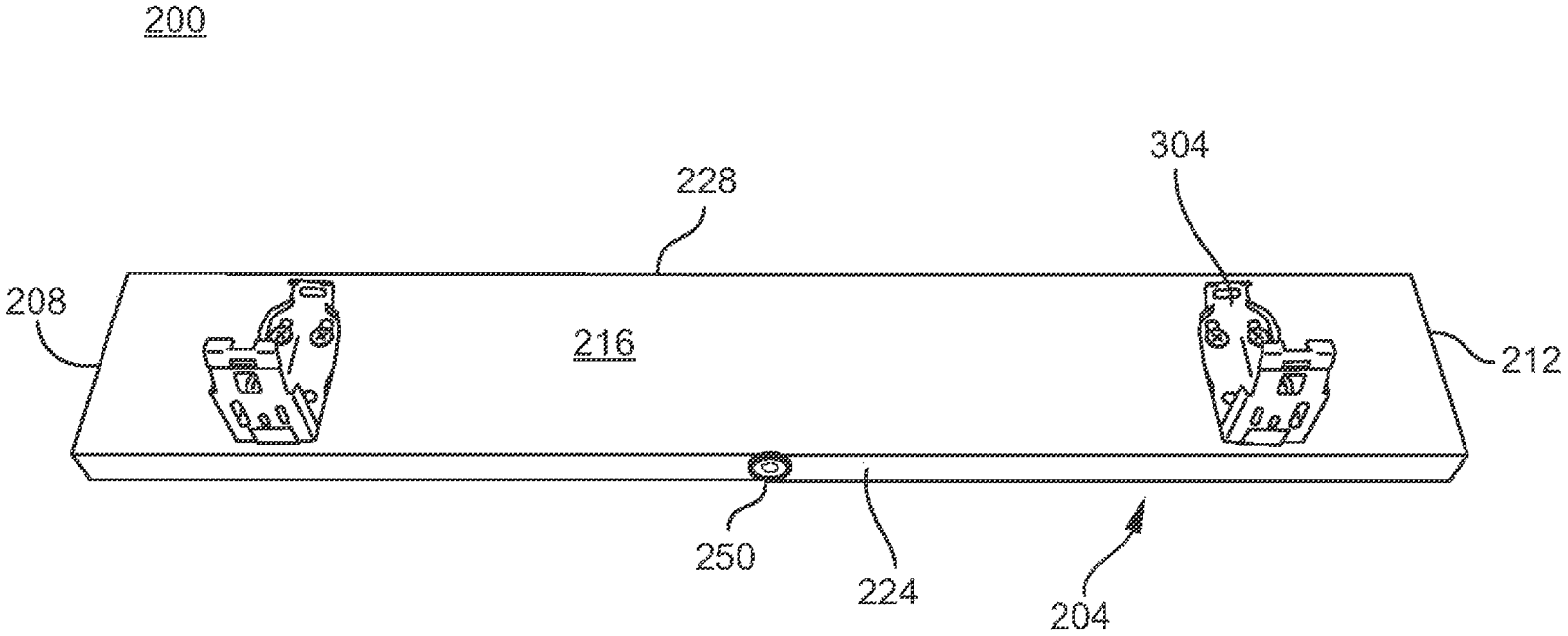
FIG. 5 is a bottom, rear, perspective view of a display board 200. Display board 200 has a bottom side 216 with mounting hardware 304.

FIG. 5 is a bottom, rear, perspective view of a display board 200. Display board 200 has a bottom side 216 with mounting hardware 304. For purposes of orientation, the left side 208, right side 212, distal face 224, proximal face 228, and top side 204 are indicated. Distal side 224 has metal component 250 that is positioned to reversibly magnetically engage with magnet 150 in display case 100.

Those of skill in the art will appreciate that the display board 200 will interact with display case 100 in that the metal component 250 on a distal face 224 of the display board allows the display board 200 to be inserted into the upper portion of the display case 100 and reversibly engage with magnet 150. Once engaged, display board 200 cannot move proximally as it is engaged with the magnet 150. The display board 200 cannot rotate around a centerline running through the magnet 150 and the metal component 204 as the display board 200 is sized to fit within the upper end of the display case 100 with minimal clearance so the top 104, left side 108, right side 112, and the display board supports 162 and 166 of the display case 100 preclude any rotation of the display board 200 or movement in the lateral or vertical directions. Thus, a display board 200 may be reversibly attached to display case 100.

Figure 6:
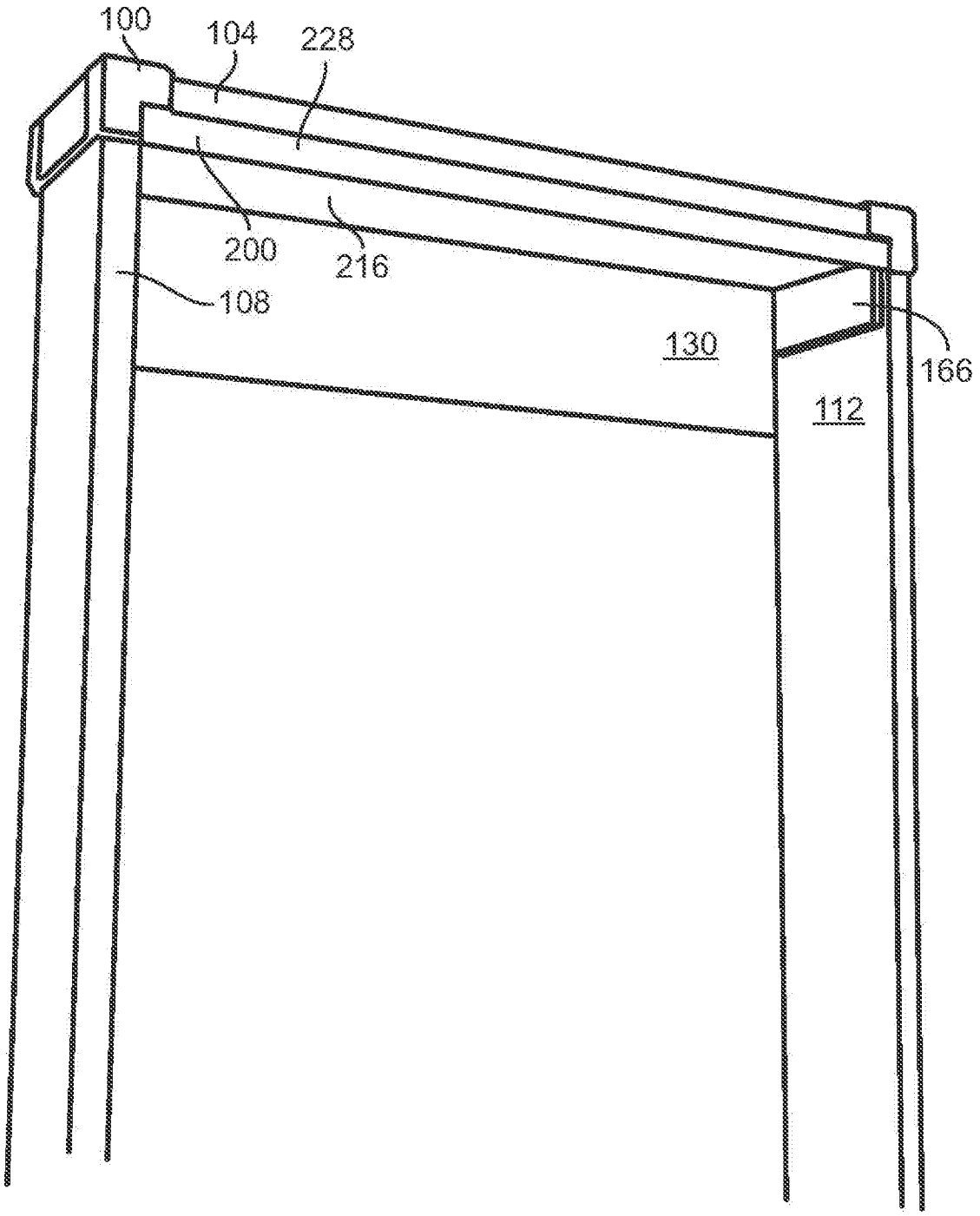
FIG. 6 is a front, left, bottom perspective view of the upper end of the display case 100 with an inserted display board 200.

FIG. 6 is a front, left, bottom perspective view of the upper end of the display case 100 with an inserted display board 200. This display board 200 is inserted for point of illustration and does not have mounting hardware 304 on the bottom 116 of the display board 200. The proximal face 228 of the display board 200 is visible but the distal face 224 with the metal component 250 is not as that face is engaged with the magnet 150. FIG. 6 shows an inserted display board 200 is trapped between the upper face of the display board support 166 and the lower face of the top 104 of the display case. Thus, the only possible movement of the display board 200 relative to the display case 100 is movement in a proximal direction but only after sufficient force is applied to overcome the magnet attraction between the magnet 150 and the metal component 250.

Figure 7:
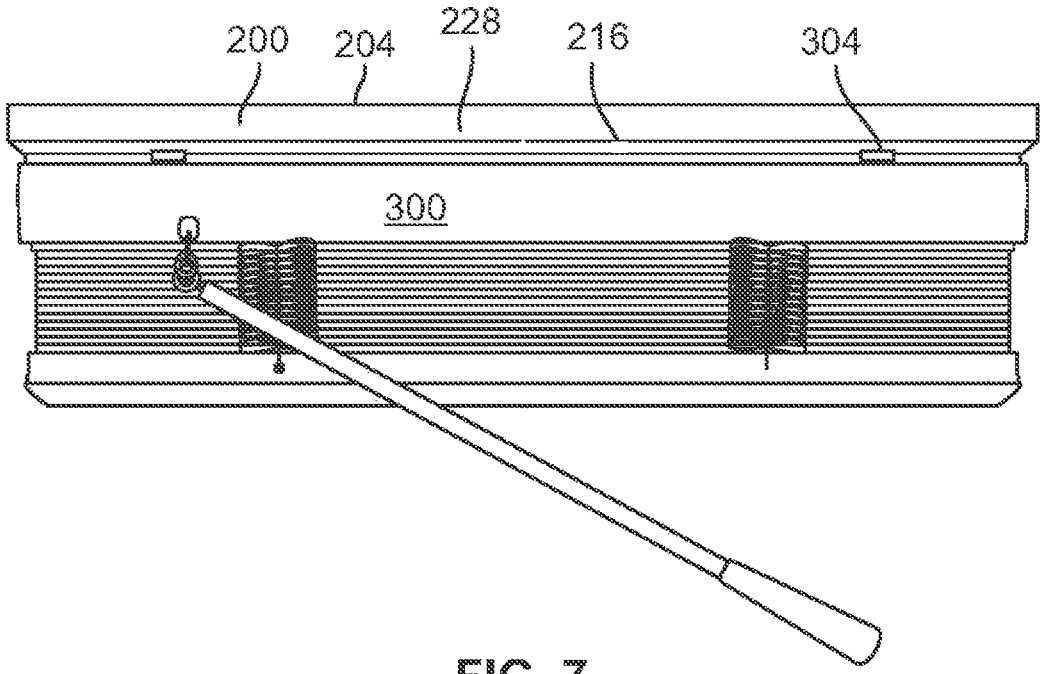
FIG. 7 shows the proximal face 228 of the display board 200 with set of blinds 300 and mounting hardware 304 on the bottom side 216 of the display board 200.
Figure 8:
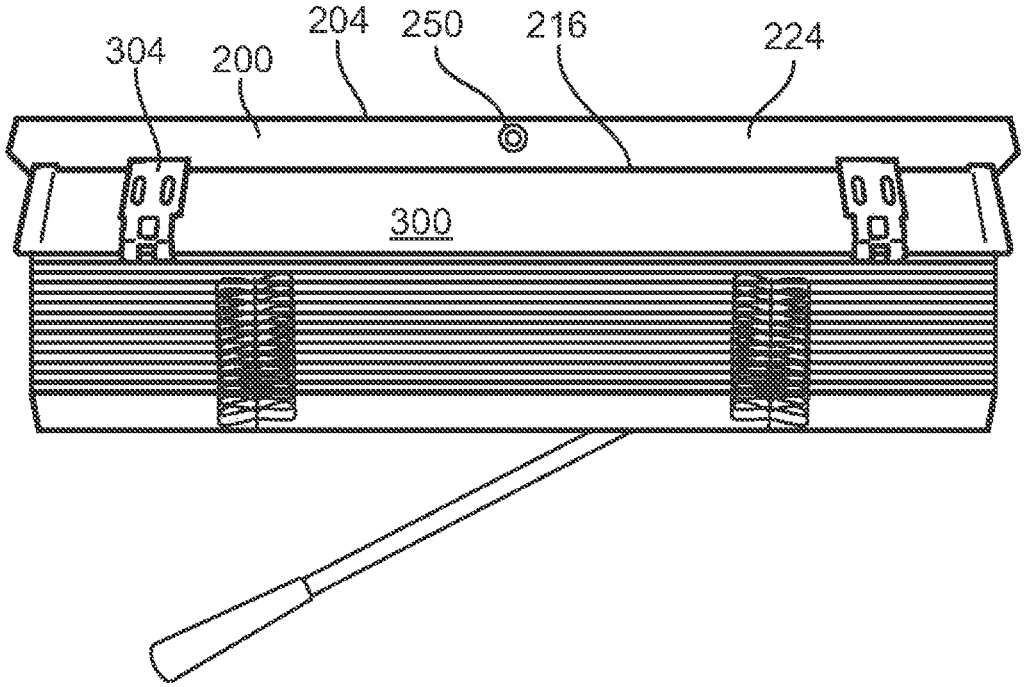
FIG. 8 shows the distal face 224 of the display board 200. The distal face 224 has the metal component 250 for engagement with the magnet 150.

FIG. 7 and FIG. 8 show a display board 200 with an engaged set of blinds 300. FIG. 7 shows the proximal face 228 of the display board 200 with set of blinds 300 and mounting hardware 304 on the bottom side 216 of the display board 200.

FIG. 8 shows the distal face 224 of the display board 200. The distal face 224 has the metal component 250 for engagement with the magnet 150. The set of blinds 300 is connected by mounting hardware 304 to the bottom side 216 of the display board.

Figure 10:
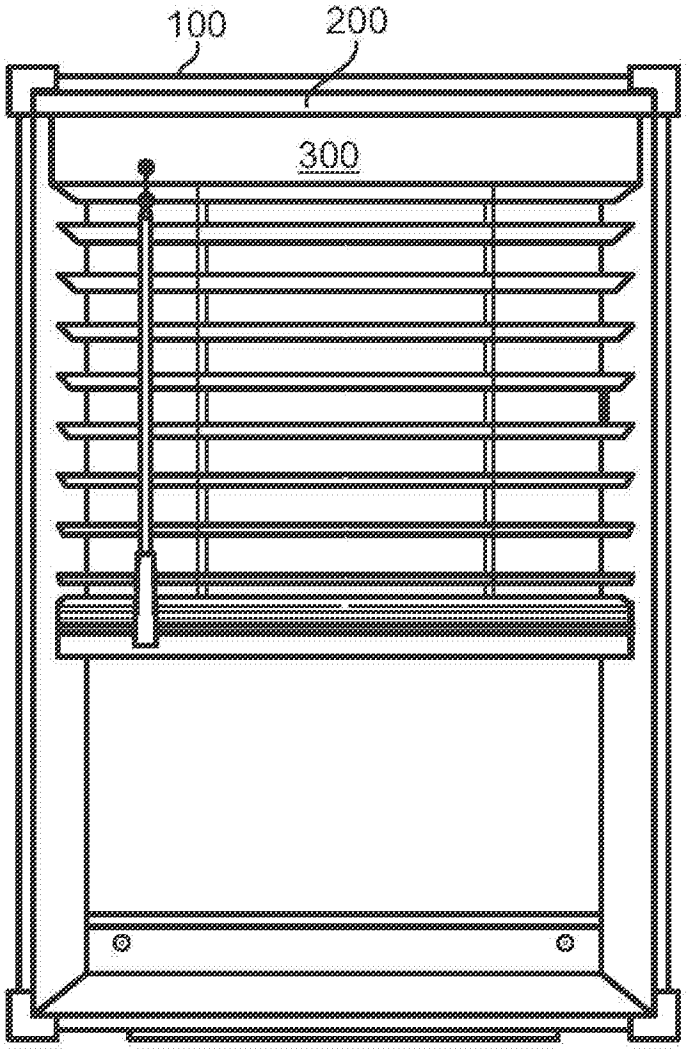
FIG. 9 and FIG. 10 show a set of blinds 300 mounted to a display board 200 inserted into a display case 100.
Figure 9:
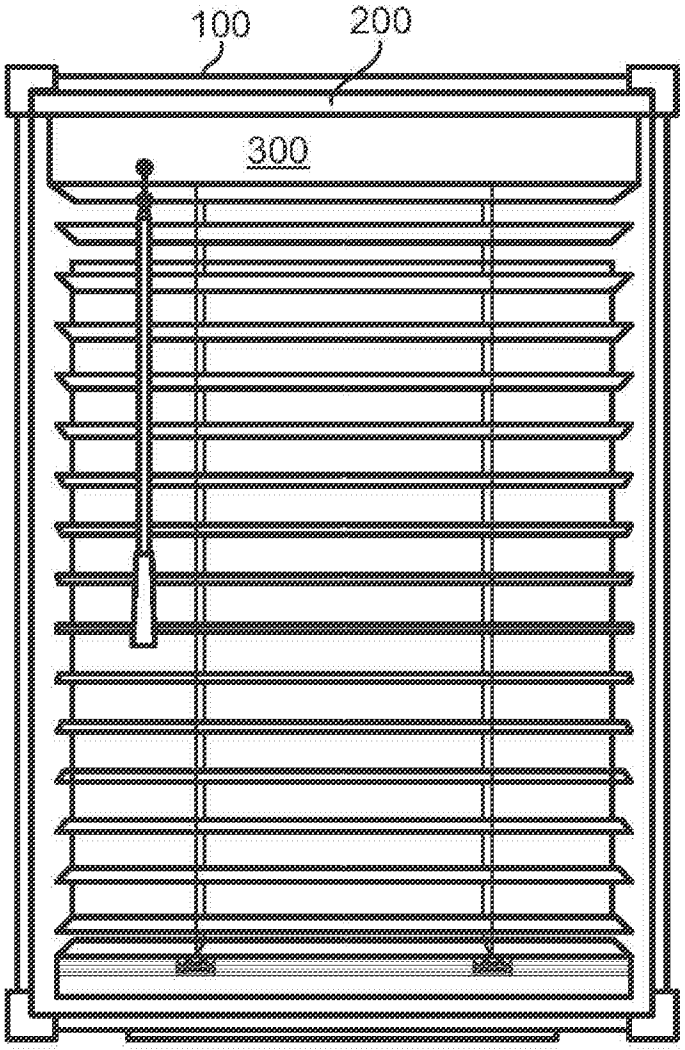

FIG. 9 and FIG. 10 show a set of blinds 300 mounted to a display board 200 inserted into a display case 100. Notice that the assembly is sufficiently stable that the set of blinds 300 may be operated to go from an extended position in FIG. 9 to a partially raised position in FIG. 10. One of skill in the art will appreciate that the blinds components can be rotated to move from a substantially horizontal orientation that allows light to pass through the blinds to a substantially vertical orientation that substantially blocks the passage of light. The details of how the set of blinds or other window coverings are manipulated to change the position of components within the window covering is irrelevant to the present application. What is relevant is the interaction between the display board 200 and the display case 100 forms a sufficiently stable temporary assembly to afford manipulations of the window covering in a stable assembly.

Outside Mount versus Inside Mount.

Figure 11:
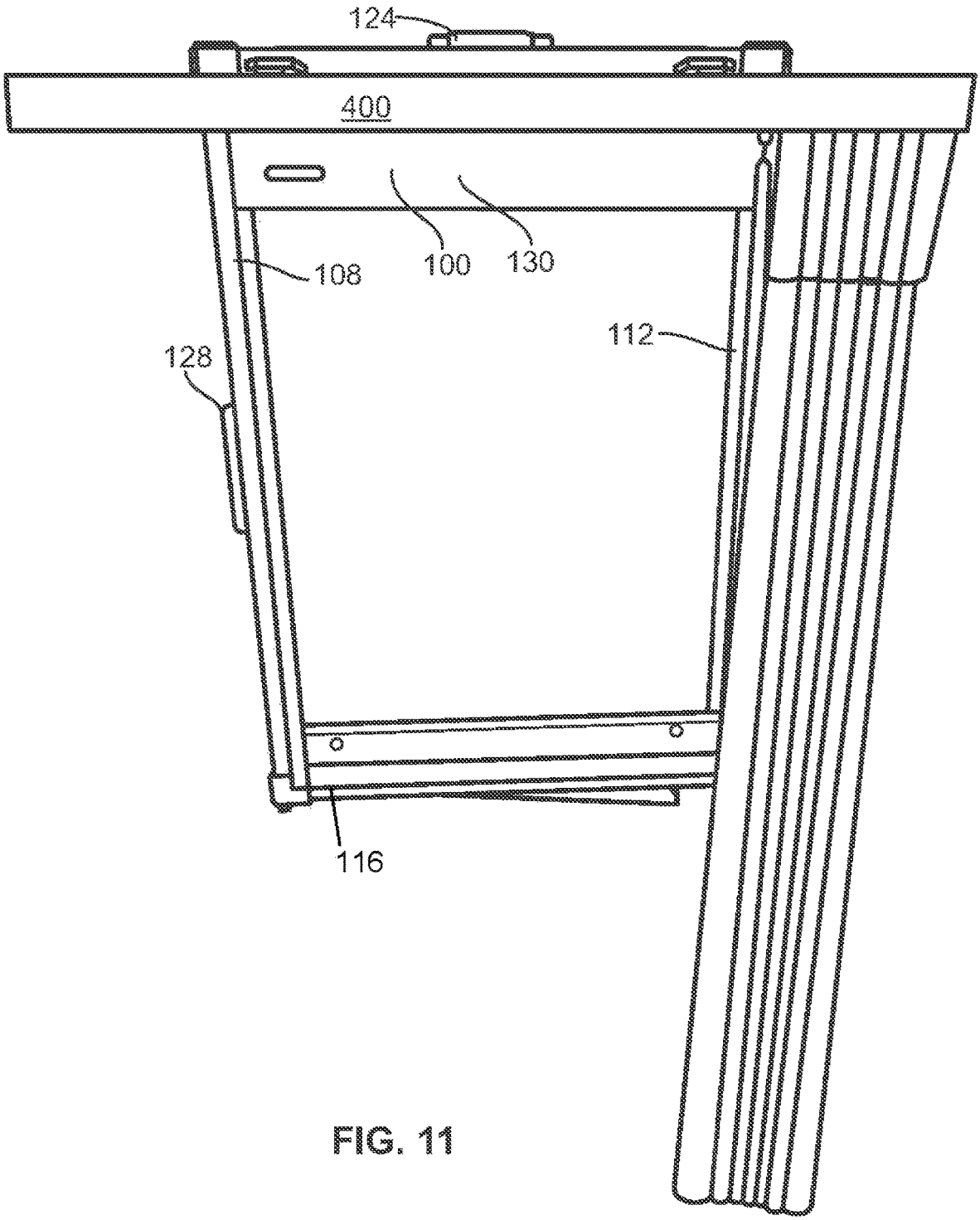
FIG. 11 shows the front side of a display case 100 with an inserted display board 200 (not visible here) and an engaged window covering 400.

FIG. 11 shows the front side of a display case 100 with an inserted display board 200 (not visible here) and an engaged window covering 400. The interaction between the set of blinds 300 and the display case 100 shown in FIG. 9 and FIG. 10 can be called an inside mount as the window covering fits within the space defined by the perimeter of the display case 100. In contrast, the window covering 400 in FIG. 11 does not fit within the perimeter of the display case 100. The inability to fit may be that the window covering 400 is too wide for the display case 100 as some window coverings do not have very narrow versions. The inability to fit may be that the length of the window covering 400 exceeds the interior height of the display case 100. In some instances as in FIG. 11, the window covering is both too wide and too long to fit within the interior of the display case.

Figure 12:
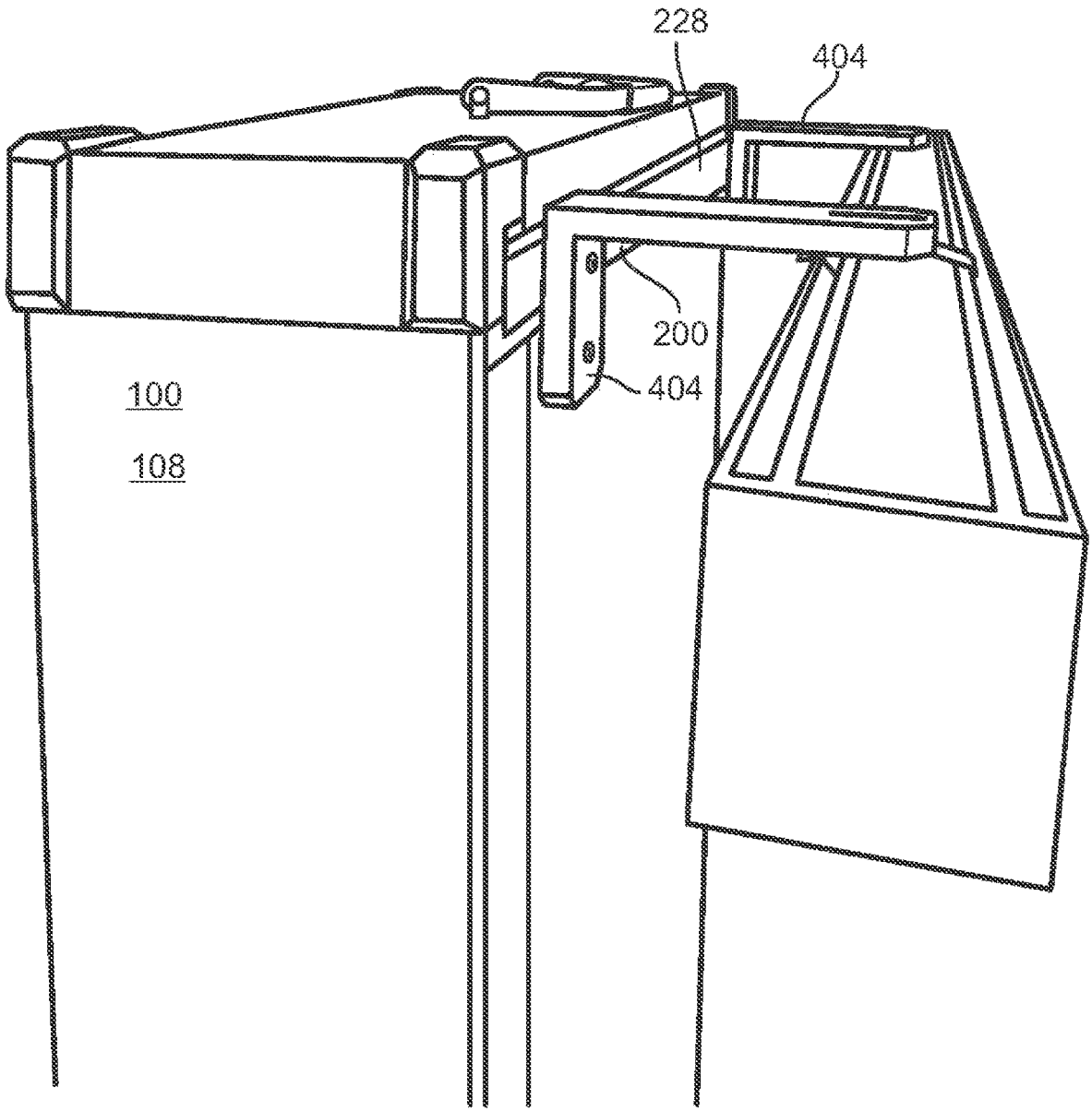
FIG. 12 shows a display case 100 with an inserted display board 200. Notice that the mounting hardware 404 is attached to the proximal face 228 of the display board 200 rather than to the bottom side 216 as was used in an inside mount.

FIG. 12 shows a display case 100 with an inserted display board 200. Notice that the mounting hardware 404 is attached to the proximal face 228 of the display board 200 rather than to the bottom side 216 as was used in an inside mount.

Figure 13:
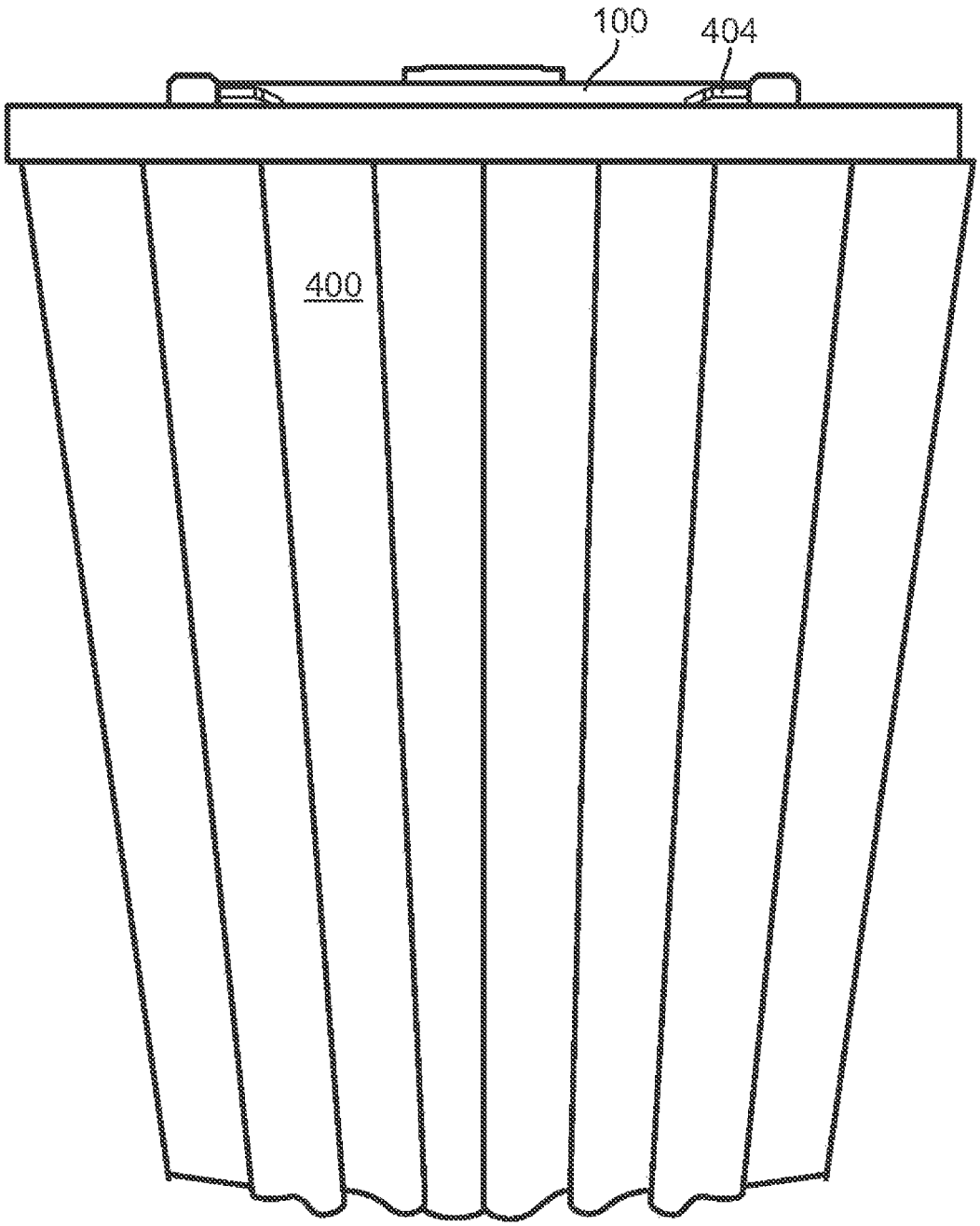
FIG. 13 shows a display case 100 with window covering 400 affixed via mounting hardware 404 to a display board 200.

FIG. 13 shows a display case 100 with window covering 400 affixed via mounting hardware 404 to a display board 200 (see FIG. 11). By positioning the display case 100 near an edge of a table, counter, or other suitable item, the length of the window covering 400 can exceed the height of the display case 100. The assembly formed by the display case 100 and display board 200 with engaged window covering 400 is sufficiently rigid that the window covering 400 may be manipulated to show the various configurations to block or allow light to pass through the window covering 400.

Magnet Choice.

A preferred choice for magnet is a neodymium magnet. These are permanent magnets that are known for their strength and are widely available. The magnets come in a variety of pull strengths so a designer can choose the amount of force needed to dislodge a display board 200 from a display case 100.

Process.

Figure 14:
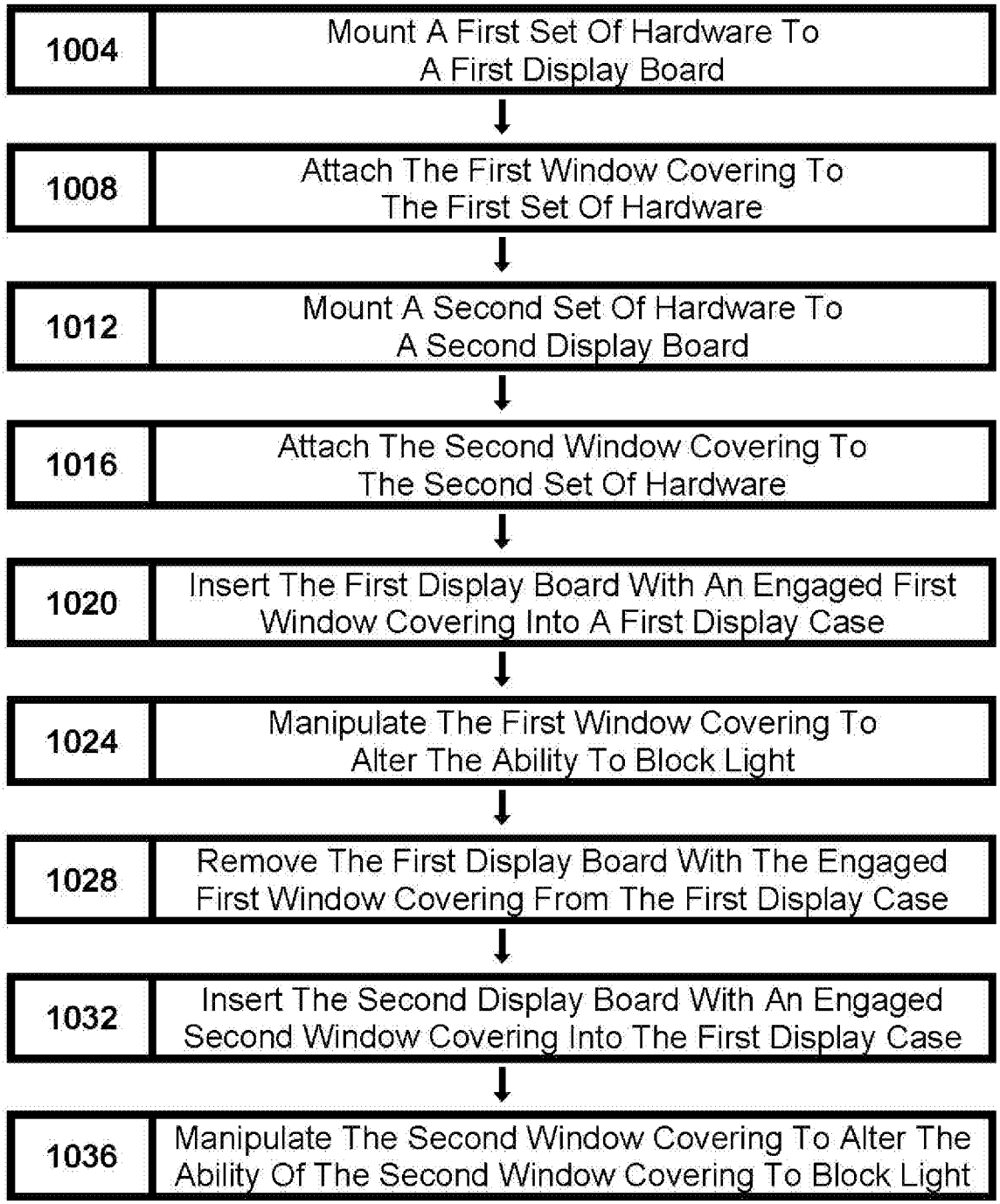
FIG. 14 has a process 1000 for using a display case 100 to display two different window coverings.

FIG. 14 has a process 1000 for using a display case 100 to display two different window coverings.

Step 1004—Mount a first set of hardware to a first display board 200 to allow a first window covering to be attached to the first display board.

Step 1008—Attach the first window covering to the first set of hardware attached to the first display board 200.

Step 1012—Mount a second set of hardware to a second display board 200 to allow a second window covering to be attached to the second display board.

Step 1016—Attach the second window covering to the second set of hardware attached to the second display board 200. Those of skill in the art recognize that the mounting of sets to hardware to the display boards and the connection of window coverings can be done in any order so long as there are two display boards with two window coverings for use in the rest of this process.

Step 1020—Insert the first display board with an engaged first window covering into a first display case so that a magnetic bond between the first display board and the first display case secures the first display board into the first display case.

Step 1024—Manipulate the first window covering to alter the ability of the first window covering to block light from passing from a distal side of the first display case to a viewer on a proximal side of the first display case.

Step 1028—Remove the first display board with the engaged first window covering from the first display case after overcoming the magnetic bond between the first display board and the first display case that previously secured the first display board into the first display case.

Step 1032—Insert the second display board with an engaged second window covering into the first display case so that a magnetic bond between the second display board and the first display case secures the second display board into the first display case.

Step 1036—Manipulate the second window covering to alter the ability of the second window covering to block light from passing from a distal side of the first display case to a viewer on a proximal side of the first display case.

Alternatives & Variations.

Bottom Backstop.

The bottom backstop is not required for all uses of the display case and one of skill in the art could omit the bottom backstop. Use of the bottom backstop can add structural stability to the display case and can be a place to have a magnetic strike to secure additional window covering hardware such as window shades that have magnetic hold downs.

Number of Magnets and Placement of Magnets.

One of skill in the art will appreciate that using one magnet will be cheaper than using more than one magnet. However, the teachings of the present disclosure are not limited to a display frame and corresponding display board with a single magnet 150 solely on the display case. One could use two or more magnets 150 on the display case with a corresponding number of metal components 250 on the distal face 224 of the display board 200.

One of skill in the art will appreciate that one or more magnets 150 could be placed on the distal face 224 of the display board and that one or more metal components 250 could be placed within the display case 100. Note, the use of one magnetic bond may be preferred as having more than one magnetic bond can lead to an issue when trying to remove the display board if one magnetic bond releases before the other magnetic bond and the display board attempts to rotate around the last magnetic bond. This issue is more of an annoyance than a failure mode but it leads to a preference for a single magnetic bond.

One of skill in the art will appreciate that if more than one magnet is used, that an elongated metal component could be used to engage with two or more magnets. Alternatively, one elongated magnet could engage with two or more metal components.

Rather than having a magnet interact with a metal component, one could have a magnet interact with another magnet if the polarity of the magnets was such that the interaction was attraction rather than repulsion.

The magnet or metal component could be recessed in the display case or mounting board providing that other geometries were adjusted so that the magnet and the metal component get close enough for a strong magnetic connection.

One of skill in the art will appreciate that rather than having the magnetic bond at the distal face of the display board as described in this disclosure, that the display board and display case could be adjusted to have a magnetic bond that interacts with the top face of the display board and the top of the display case. One or more magnetic bonds could be employed to bind the side edges of the display board with the sides of the display case.

Likewise, the pair of display board supports 162 and 166 which define a lower plane to limit the position of a display board 200 could be adapted to interact with the display board to form one or more magnetic bonds to reversibly lock the display board into the display case. It is likely that the components (magnets and metallic components if used) would be recessed into the surfaces of the display board and display case when using one or more magnetic bonds between the sides, top, or bottom of the display board and the display case but this is not required.

Adjustments to the location of the magnetic bond may lead to other adjustments of the specific size and shape of the display board and display case so that the display board is closely constrained by the display case.

Alternatives to Magnets.

Those of skill in the art will appreciate that while magnetic bonds are well suited for use in the temporary bond between the display board 200 and the display case 100, that other options could be employed. Kitchen drawers and cabinets have a number of latching mechanisms that allow one object to move towards another and make reversible engagement with a latching mechanism. The force to unlatch is sufficiently high to preclude unintentional movement of the latched item. However, the force to unlatch is sufficiently low to allow a user to pull in the item and easily unlatch and move the item.

Illustrative but non-limiting examples of latching mechanisms include grab latches of various shapes and geometries and ball detent mechanisms. One of skill in the art will appreciate that the geometry of the display board and the display case may need to be altered in order to provide room for both the latch hardware and for the latch engagement.

Mounting Hardware.

The present disclosure shows mounting hardware 304 and 404 to illustrate inside mount and outside mount uses of the display boards. Those of skill in the art will appreciate that there are many different window coverings that have many different types of mounting hardware. The present disclosure extends to all types of window coverings and mounting hardware that would benefit from the teachings of the present disclosure. Those of skill in the art will appreciate that the mounting hardware for a particular window covering may use a set of one or more pieces of mounting hardware.

In many instances the mounting hardware will be engaged with the display board through the use of wood screws as the display board may be made of wood. However, this is not a requirement of the present disclosure. The mounting hardware could be engaged using adhesive, welding, or any other manner of attaching one component to another component as that is not a focus of the present disclosure.

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Moreover, the scope of the claims which follow covers the range of variations, modifications, and substitutes for the components described herein as would be known to those of skill in the art.

Where methods and/or events described above indicate certain events and/or procedures occurring in a certain order, the ordering of certain events and/or procedures may be modified. Additionally, certain events and/or procedures may be performed concurrently in a parallel process when possible, as well as performed sequentially as described above.

The legal limitations of the scope of the claimed invention are set forth in the claims that follow and extend to cover their legal equivalents. Those unfamiliar with the legal tests for equivalency should consult a person registered to practice before the patent authority which granted this patent such as the United States Patent and Trademark Office or its counterpart.

What is claimed is:

1. An assembly for display of a window covering, the assembly comprising:

a window covering with a set of at least one piece of mounting hardware for the window covering, the set of at least one piece of mounting hardware engaged with a display board;

a display case that is adapted for movement for use in a sales presentation at a customer's location, the with a top side, left side, right side, and bottom side;

the display case forming a display case frame with a non-zero depth distance between a proximal side of the display case and a distal side of the display case;

the display case adapted to reversibly hold the display board near the top of the display case through a magnetic bond between the display case and the display board;

the display board inserted into an opening on the proximal side of the display case such that the display board is at least partially surrounded by the display case frame;

the window covering engaged with the set of at least one piece of mounting hardware so that the window covering, the set of at least one piece of mounting hardware, and the display board adapted for removal from the assembly such that a different mounting board with a different set of at least one piece of mounting hardware and a different window covering may be inserted in the display case.

2. The assembly of claim 1 wherein the magnetic bond is formed between a magnet located on the display case and a metallic component on the display board.

3. The assembly of claim 1 wherein the magnetic bond is formed between a magnet located on the display board and a metallic component on the display case.

4. The assembly of claim 1 wherein the magnetic bond involves at least two magnets.

5. The assembly of claim 1 wherein the magnetic bond is between a distal face of the display board and the display case.

6. The assembly of claim 1 wherein the magnetic bond is between a top side of the display board and the display case.

7. The assembly of claim 1 wherein the magnetic bond is between a bottom side of the display board and the display case.

8. The assembly of claim 1 wherein at least one magnetic bond between the display board interacts with one of the side walls.

9. The assembly of claim 1 wherein the set of at least one piece of mounting hardware is engaged with a bottom side of the display board.

10. The assembly of claim 1 wherein the set of at least one piece of mounting hardware is engaged with a proximal side of the display board and a width of the window covering exceeds a width of the display case.

11. A process for using the assembly of claim 1 to sequentially display two different window coverings, the process comprising:

mounting a first set of hardware to a first display board to allow a first window covering to be attached to the first display board;

attaching the first window covering to the first set of hardware attached to the first display board;

mounting a second set of hardware to a second display board to allow a second window covering to be attached to the second display board;

attaching the second window covering to the second set of hardware attached to the second display board;

inserting the first display board with the attached first window covering into the assembly so that a first magnetic bond between the first display board and the assembly secures the first display board into the single display case assembly;

manipulating the first window covering to alter an ability of the first window covering to block light from passing from a distal side of the assembly to a viewer on a proximal side of the assembly;

removing the first display board with the attached first window covering from the assembly after overcoming the magnetic bond between the first display board and the assembly that previously secured the first display board into the assembly;

inserting the second display board with the attached second window covering into the assembly so that a second magnetic bond between the second display board and the assembly secures the second display board into the assembly; and manipulating the second window covering to alter an ability of the second window covering to block light from passing from the distal side of the assembly to the viewer on the proximal side of the assembly.

12. The process of claim 11 wherein the first set of hardware has just one piece that is attached to the first display board.

13. The process of claim 11 wherein the second set of hardware has just one piece that is attached to the first display board.

* * * * *